US005379487A

United States Patent [19]

Bowers

[11] Patent Number: 5,379,487

[45] Date of Patent: Jan. 10, 1995

[54] HINGE WITH ADJUSTABLE HINGE ARM

[75] Inventor: Michael J. Bowers, Rockford, Ill.

[73] Assignee: Amerock Corporation, Rockford, Ill.

[21] Appl. No.: 93,588

[22] Filed: Jul. 19, 1993

[51] Int. Cl.[6] ..... E05D 7/04; E05D 7/12

[52] U.S. Cl. ..... 16/240; 16/236; 16/249; 16/DIG. 43

[58] Field of Search ..... 16/236, 237, 238, 239, 16/240, 250, DIG. 43, 246, 249

[56] References Cited

U.S. PATENT DOCUMENTS

| | | | |
|---|---|---|---|
| 4,045,841 | 9/1977 | Rock et al. | 16/129 |
| 4,615,072 | 10/1986 | Lautenschlager, Jr. | 16/238 |
| 4,674,150 | 6/1987 | Salice | 16/382 |
| 5,029,362 | 7/1991 | Prodan | 16/236 |
| 5,144,722 | 9/1982 | Salice | 16/240 |
| 5,193,247 | 3/1993 | Placer et al. | 16/236 |

FOREIGN PATENT DOCUMENTS

| | | | |
|---|---|---|---|
| 2356000 | 5/1975 | Germany | 16/249 |
| 2839576 | 3/1980 | Germany | 16/DIG. 43 |
| 3444994A1 | 12/1986 | Germany | 16/249 |
| 3725942 | 2/1989 | Germany | 16/250 |
| 2178791A | 7/1986 | United Kingdom | 16/249 |

*Primary Examiner*—Lowell A. Larson
*Assistant Examiner*—Donald M. Gurley
*Attorney, Agent, or Firm*—Leydig, Voit & Mayer

[57] ABSTRACT

Two screws are threaded into two holes in a hinge arm which is adapted to be assembled with a base plate by shifting the arm longitudinally to cause the screws to slide into two U-shaped slots in the plate, the slots permitting longitudinal adjustment of the hinge arm. One of the screws may be turned to adjust the inclination of the hinge arm relative to the base plate while the other screw serves to lock the arm to the plate.

8 Claims, 2 Drawing Sheets

HINGE WITH ADJUSTABLE HINGE ARM

BACKGROUND OF THE INVENTION

This invention relates to a hinge of the type in which a hinge arm is mounted on a cabinet side panel or the like by a base plate and is connected pivotally to a hinge member secured to the door of the cabinet. Hinges of this general type are disclosed in Röck et al U.S. Pat. No. 4,045,841; Laütenschläger U.S. Pat. No. 4,615,072; Salice U.S. Pat. No. 4,674,150; Salice U.S. Pat. No. 5,144,722; German Patent Specification No. DE 34 44 994 A1 and United Kingdom Patent Specification No. 2,178,791 A.

In hinges of this type, it is virtually an essential requirement that the hinge be attached to the door, be hung on the base plate and then be adjustable both longitudinally of the base plate and also toward or away from the base plate before being secured thereto. While prior hinges are capable of satisfying this requirement by means of a locking screw and an adjustment screw, virtually all such hinges require that a longitudinally extending slot be formed in the hinge arm to enable the arm to be adjusted longitudinally with respect to the locking screw. Such a slot tends to detract from the appearance of the hinge arm. Also, prior hinges require that one threaded hole be formed in the hinge arm for the adjusting screw and that a second threaded hole be formed in the base plate for the locking screw. As a result, both components must be tapped during manufacture.

SUMMARY OF THE INVENTION

The general aim of the present invention is to provide a new and improved hinge of the above type in which the unsightly slot in the hinge arm is eliminated and in which the need for tapping the base plate is avoided, thereby to improve the appearance of the hinge arm and to avoid the expense of forming a tapped hole in the base plate.

A more detailed object of the invention is to achieve the foregoing by providing a hinge arm having two tapped holes for receiving a locking screw and an adjustment screw, the shanks of the screws being received in slots in the base plate to securely lock the hinge arm to the base plate while permitting the required adjustments of the hinge arm.

A further object is to locate the slots in the base plate in a common plane in order to facilitate quick and easy initial assembly of the hinge arm to the base plate.

Another object is to extrude the locking screw hole in the hinge arm and to use the extrusion to capture the hinge arm longitudinally on the base plate in the event the locking screw becomes loose.

The invention also resides in the unique provision of a locking screw with a left hand thread in order to enable the locking screw to clamp the hinge arm to the base plate when the screw is turned in the normal (i.e., clockwise) direction for tightening.

These and other objects and advantages of the invention will become more apparent from the following detailed description when taken in conjunction with the accompanying drawings.

DETAILED DESCRIPTION OF THE PREFERRED EMBODIMENT

Figure 1:
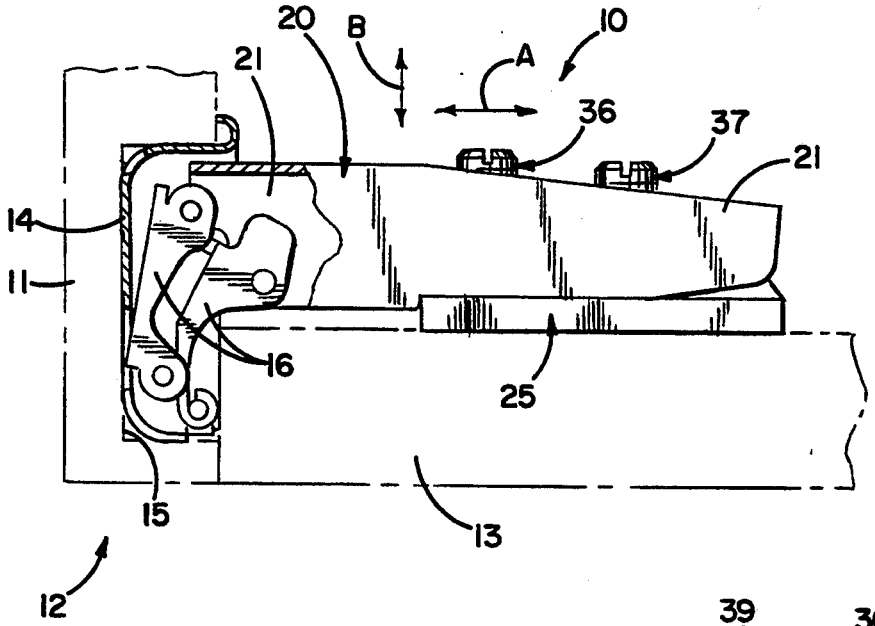
FIG. 1 is a top plan view showing a new and improved hinge incorporating the unique features of the present invention installed in a typical cabinet, portions of the hinge being broken away and shown in section.

As shown in the drawings for purposes of illustration, the invention is incorporated in a so-called European-style hinge 10 of the type used to swingably connect an overlay door 11 of a cabinet 12 to a cabinet side panel 13. In the present instance, the hinge includes a door member 14 in the form of a cup which is received in a mortised hole 15 formed in the rear side of the door, the cup 14 being secured to the door by screws (not shown). Two toggle links 16 pivotally connect the cup 14 to an elongated hinge arm 20 made of sheet metal and formed with a generally inverted U-shaped cross-section, the arm thus having two wings 21 joined by a web 22. The hinge arm is supported by a base plate 25 which, in turn, is fastened to the inner side of the cabinet panel 13 by three screws (not shown).

Figure 5:
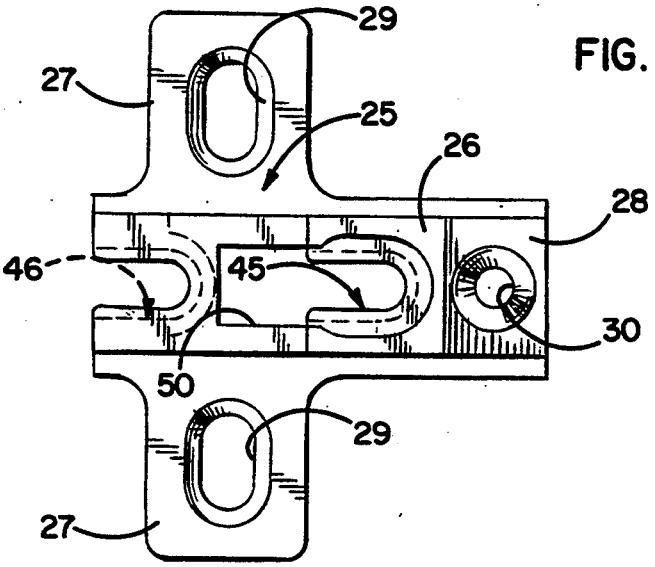
FIG. 5 is a top plan view of the base plate shown in FIG. 4.

Herein, the base plate 25 is generally T-shaped (see FIG. 5) and includes a body 26 with two vertically extending wings 27 and with a rearwardly extending stem 28. Vertically elongated holes 29 in the wings receive two of the screws to enable the hinge 10 to be shifted upwardly or downwardly on the side panel 13 in order to effect proper vertical adjustment of the door 11 relative to the front opening of the cabinet 12. Once that adjustment has been completed, the base plate is locked to the side panel by driving the remaining screw into the side panel through a circular hole 30 in the stem 28 of the base plate.

Two additional adjustments are necessary in order to properly position the door 11 relative to the side panel 12. That is, the hinge arm 20 must be capable of being adjusted longitudinally in the directions of the double arrow A relative to the base plate 25 in order to establish a gap of predetermined width between the rear side of the door and the front edge of the panel. Secondly, the hinge arm must be capable of being rocked transversely relative to the base plate in the directions of the double arrow B in order to establish the proper relationship between the inner side of the side panel and the adjacent edge of the door. It is most desirable that these adjustments be made while the hinge arm is attached to the door and is hanging on the installed base plate so that the position of the door relative to the panel may be visually determined.

In accordance with the present invention, the hinge arm 20 and the base plate 25 are uniquely constructed to enable the arm to be properly adjusted and locked to the plate without need of slotting the arm and without need of forming tapped holes in the plate. The slotless arm possesses a relatively streamlined appearance while the elimination of tapped holes in the plate helps reduce manufacturing costs.

More specifically, the web 22 of the U-shaped arm 20 is formed with two longitudinally spaced holes 32 and 33 which preferably are made by a punching/extrusion operation such that the holes 32 and 33 are defined in part by tubular bosses 34 and 35, respectively, on the inside face of the web 22. After being formed, the hole 32 is tapped with a right hand thread while the hole 33 preferably is tapped with a left hand thread.

The holes 32 and 33 are adapted to receive an adjusting screw 36 and a locking screw 37, respectively. The two screws are identical except that the screw 36 is formed with a threaded portion 38 with a right hand thread while the screw 37 is formed with a threaded portion 38' with a left hand thread. The threaded portion of each screw forms part of a shank having a drive slot 39 at one end and terminating in an unthreaded section or button 40 at its opposite end. An annular groove 41 in each shank divides the threaded portion from the unthreaded button 40.

Figure 4:
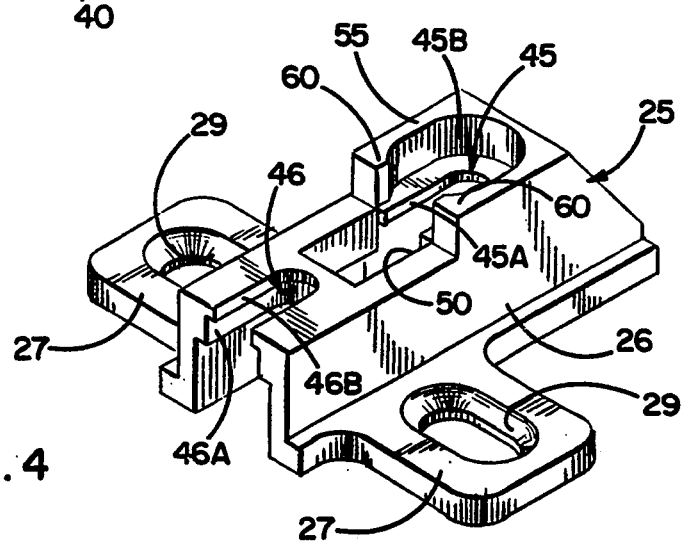
FIG. 4 is an enlarged perspective view of the base plate.

In carrying out the invention, the base plate 25 is formed with a generally U-shaped slot 45 (FIG. 4) for receiving the shank of the locking screw 37 and preferably is formed with a second generally U-shaped slot 46 spaced longitudinally from the slot 45 and adapted to receive the shank of the adjusting screw 36. The slot 45 includes a narrow section 45A whose edges are adapted to straddle the groove 41 of the locking screw 39 and further includes a wide section 45B for receiving the boss 35. The slot 46 is undercut and includes a relatively wide section 46A for receiving the button 40 of the adjusting screw 36 and a narrower section 46B with longitudinally extending edge portions adapted to be received in the groove 41 of the screw 36 in straddling relationship with the shank so that the edge portions of the narrow slot section are located between the threaded portion 38 and the button 40. The narrow sections of the two U-shaped slots are located in a common plane, the slots being oriented such that they open in a direction longitudinally of the hinge arm 20. For a purpose to be explained subsequently, a generally rectangular opening or window 50 (FIG. 4) is formed in the base plate 25 between the two slots 45 and 46 and communicates with the open end of the slot 45.

Figure 2:
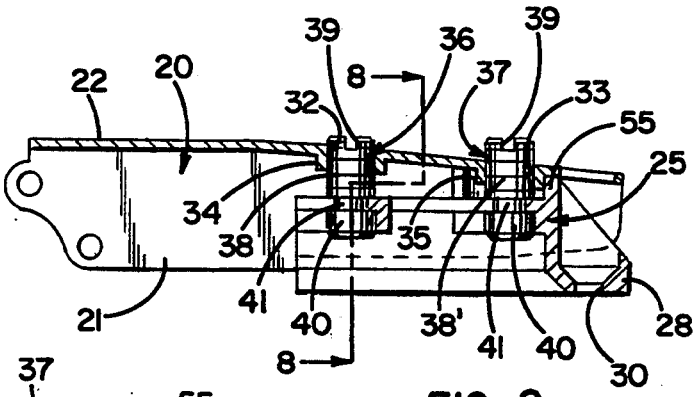
FIG. 2 is a cross-section taken longitudinally through the hinge arm and the base plate.
Figure 3:
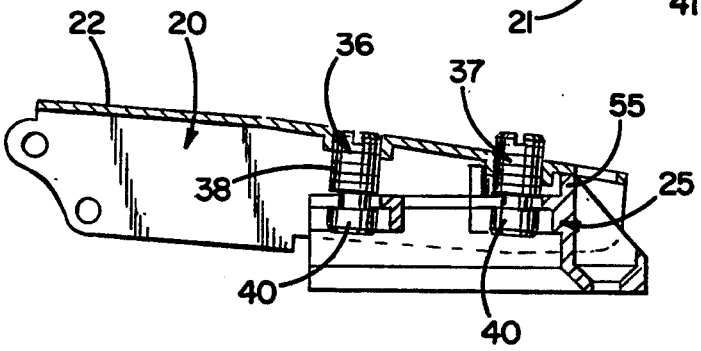
FIG. 3 is a view similar to FIG. 2 but shows the hinge arm in an adjusted position.
Figure 6:
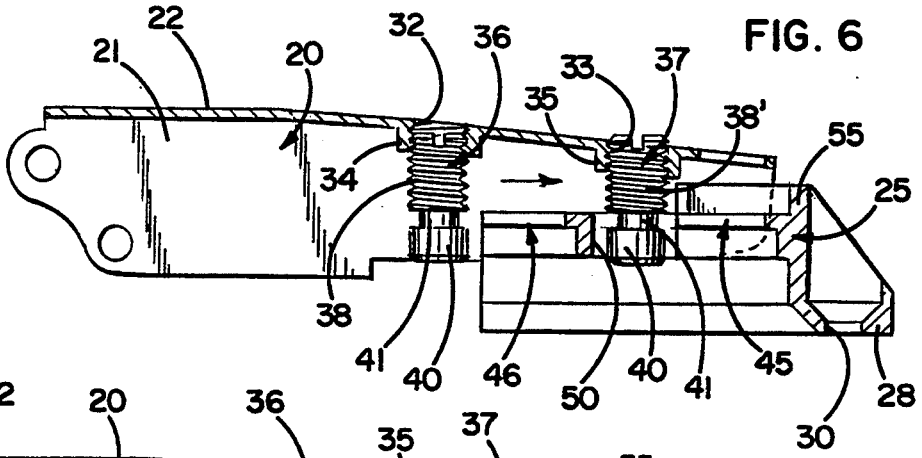
FIGS. 6 and 7 are enlarged views generally similar to FIG. 2 but show successive steps of installing the hinge arm one the base plate.
Figure 7:
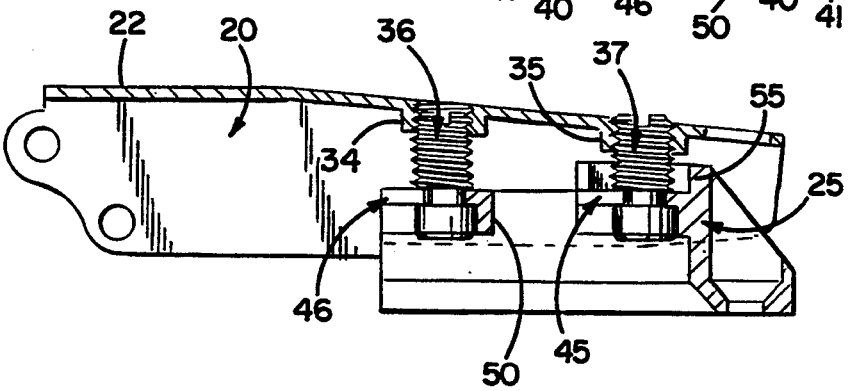
Figure 8:
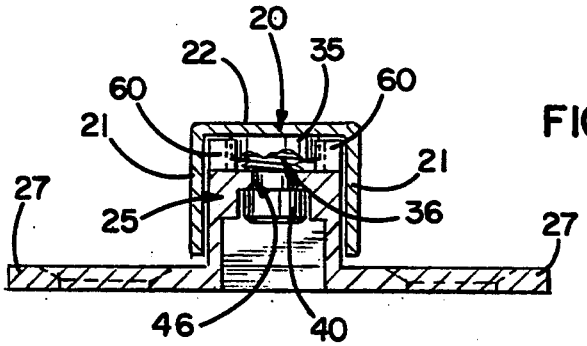
FIG. 8 is a cross-section taken substantially along the line 8-8 of FIG. 2.

Assembly of the hinge arm 20 with the base plate 25 is effected while the screws 36 and 37 are positioned axially in the holes 32 and 33 as shown in FIG. 6 with the two grooves 41 in approximate alignment with one another. The arm is positioned such that the locking screw 37 may be inserted endwise into the window 50 (see FIG. 6) and then the arm is slid longitudinally to cause the grooves 41 of the screws 36 and 37 to enter the narrow sections of the slots 46 and 45, respectively, as shown in FIG. 7. As a result of the slots, the arm may be correctly positioned longitudinally in the direction of the double arrow A (compare FIGS. 2 and 3). The locking screw 37 then may be tightened or partially tightened by turning the screw clockwise or to the right in the conventional tightening direction. By virtue of the left hand thread of the locking screw, such turning retracts the screw, causing the button 40 thereof to clamp against the edge portions of the narrow section 45A of the slot 45 and causing the web 22 of the hinge arm to be clamped against a raised platform 55 (FIG. 4) extending around the edge portions of the wide section 45B of the slot 45. As the screw 37 is tightened, the boss 35 around the hole 33 is drawn into the wide portion of the slot 45 (see FIG. 2).

After the locking screw 37 has been partially tightened, the adjusting screw 36 may be turned to tilt the hinge arm in the direction of the double arrow B. Clockwise turning of the adjusting screw causes the end of the threaded portion 38 to bear against the edge portions of the narrow slot section 46B and effect tilting of the front end portion of the hinge arm 20 away from the cabinet side panel 13 (compare FIGS. 2 and 3). Counterclockwise turning of the adjusting screw causes the button 41 to react against opposite sides of the edge portions of the narrow slot section 46B and effect reverse tilting of the forward end portion of the hinge arm. Once the arm has been properly positioned in the direction of the double arrow A and B, the locking screw 37 may be fully tightened in order to fix the arm to the base plate 25.

Advantageously, means are provided for preventing the hinge arm 20 from slipping longitudinally off of the base plate 25 and allowing the cabinet door 11 to fall in the event the locking screw 37 becomes loose. Herein, these means are defined by two nibs 60 (FIG. 4) formed on the base plate 25 near the open end of the wide section 45B of the slot 45. The distance between the nibs is less than the diameter of the extruded boss 35. As a result, the nibs trap the boss 35 longitudinally in the slot section 45B and prevent the hinge arm from separating longitudinally from the base plate 25 if the screw 37 loosens.

I claim:

1. A hinge comprising a base plate adapted to be attached to a stationary cabinet member, a longitudinally extending hinge arm attachable to said base plate, and a hinge member pivotally attached to said hinge arm and adapted to be attached to a cabinet door, two threaded holes formed through and spaced longitudinally along said hinge arm, first and second screws threaded into said holes, each of said screws including a shank having an annular groove formed therearound, said base plate having first and second longitudinally spaced and generally U-shaped slots opening in a direction longitudinally of said hinge arm, each of said slots having longitudinally extending edge portions adapted to be received in the groove of the respective screw in straddling relation with the shank thereof when said hinge arm is moved longitudinally into assembled relation with said base plate, said first screw being operable when tightened to clamp said hinge arm and said base plate in assembled relation, and said second screw bearing against said base plate and being operable when adjusted to change the inclination of said hinge arm relative to said base plate.

2. A hinge as defined in claim 1 in which said first and second screws have threads of opposite hand.

3. A hinge as defined in claim 2 in which said first and second screws have left and right hand threads, respectively.

4. A hinge as defined in claim 1 in which the longitudinally extending edge portions of said two slots are disposed in substantially the same plane.

5. A hinge comprising a base plate adapted to be attached to a stationary cabinet member, a longitudinally extending hinge arm attachable to said base plate, and a hinge member pivotally attached to said hinge arm and adapted to be attached to a cabinet door, first and second threaded holes formed through and spaced longitudinally along said hinge arm, first and second screws threaded into said first and second holes, respectively, each of said screws including a shank having an annular groove formed therearound, said base plate having first and second longitudinally spaced and generally U-shaped slots opening in a direction generally longitudinally of said hinge arm, said first and second slots having longitudinally extending edge portions disposed in substantially the same plane and positioned to be received in the grooves of said first and second screws, respectively, in straddling relation with the shanks thereof when said hinge arm is moved longitudinally into assembled relation with said base plate, said first screw being operable when tightened to coact with the edge portions of said first slot and clamp said hinge arm and said base plate in assembled relation, and said second screw being operable when tightened to coact with the edge portions of said second slot and change the inclination of said hinge arm relative to said base plate.

6. A hinge as defined in claim 5 in which said base plate includes a window located between said first and second slots and communicating with said first slot whereby said first screw may be inserted endwise into said window prior to said hinge arm being moved longitudinally into assembled relation with said base plate.

7. A hinge as defined in claim 6 further including a tubular boss formed on said hinge arm and concentric with said first hole, said boss facing said base plate, said first slot having a widened generally U-shaped portion adapted to receive said boss when said first screw is tightened, and means formed on said base plate near the open end of said widened portion of said second slot and engageable with said boss to capture said hinge arm against longitudinal separation from said base plate.

8. A hinge as defined in claim 5 in which said first and second screws are formed with left and right hand threads, respectively.

* * * * *